US009427620B2

(12) United States Patent
Oblak et al.

(10) Patent No.: US 9,427,620 B2
(45) Date of Patent: Aug. 30, 2016

(54) EXERCISE MACHINE

(71) Applicant: medica Medizintechnik GmbH, Hochdorf (DE)

(72) Inventors: Jakob Oblak, Straza (SI); Zlatko Matjacic, Ljubljana (SI)

(73) Assignee: medica-Medizintechnik GmbH, Hochdorf (DE)

( * ) Notice: Subject to any disclaimer, the term of this patent is extended or adjusted under 35 U.S.C. 154(b) by 33 days.

(21) Appl. No.: 14/275,318

(22) Filed: May 12, 2014

(65) Prior Publication Data

US 2014/0243159 A1 Aug. 28, 2014

Related U.S. Application Data

(63) Continuation of application No. PCT/DE2012/100310, filed on Oct. 4, 2012.

(30) Foreign Application Priority Data

Nov. 10, 2011 (DE) ..... 10 2011 055 202

(51) Int. Cl.
*A63B 22/00* (2006.01)
*A63B 22/06* (2006.01)

(52) U.S. Cl.
CPC ..... *A63B 22/0605* (2013.01); *A63B 22/001* (2013.01); *A63B 22/0005* (2015.10); *A63B 22/0015* (2013.01); *A63B 22/0664* (2013.01); *A63B 22/0694* (2013.01); *A63B 2022/0617* (2013.01); *A63B 2022/0623* (2013.01); *A63B 2022/0629* (2013.01); *A63B 2022/0688* (2013.01)

(58) Field of Classification Search
USPC ..... 482/1–148
See application file for complete search history.

(56) References Cited

U.S. PATENT DOCUMENTS

| | | | | |
|---|---|---|---|---|
| 3,865,366 | A | 2/1975 | Stantial | |
| 4,915,374 | A | 4/1990 | Watkins | |
| 6,334,836 | B1 | 1/2002 | Segasby | |
| 6,474,193 | B1 * | 11/2002 | Farney | A63B 22/0605 74/594.3 |
| 6,820,517 | B1 * | 11/2004 | Farney | A63B 22/0605 74/594.3 |
| 7,504,737 | B2 * | 3/2009 | Vasilovich | A63B 21/0053 290/1 C |
| 8,668,629 | B2 * | 3/2014 | Tamari | A63B 22/0015 482/51 |
| 9,126,078 | B2 * | 9/2015 | Anderson | A63B 71/0622 |
| 2014/0243159 | A1 * | 8/2014 | Oblak | A63B 22/001 482/57 |

FOREIGN PATENT DOCUMENTS

| | | | |
|---|---|---|---|
| DE | 33 46 139 | A1 | 7/1985 |
| WO | WO 2006/004430 | A2 | 1/2006 |
| WO | WO 2006/011812 | A1 | 2/2006 |

* cited by examiner

*Primary Examiner* — Stephen Crow
(74) *Attorney, Agent, or Firm* — Muncy, Geissler, Olds & Lowe, P.C.

(57) ABSTRACT

An exercise machine for exercising at least one limb, in particular for use in rehabilitation and/or fitness, with a supporting frame and a generator of circular motion, which can be rotated on a rotary shaft associated with the supporting frame, and a limb support for resting and/or supporting at least one limb. A rotational shaft arranged radially off-set with respect to the rotary shaft of the generator of circular motion is associated with the generator of circular motion to rotatably mount a rotator. The limb support is associated with the rotator, preferably eccentric to the rotational shaft. The trajectory of the limb support is elliptical, the ellipse being formed by an overlapping of the circular motions of the generator of circular motion and the rotator.

11 Claims, 4 Drawing Sheets

EXERCISE MACHINE

This nonprovisional application is a continuation of International Application No. PCT/DE2012/100310, which was filed on Oct. 4, 2012, and which claims priority to German Patent Application No DE 10 2011 055 202.2, which was filed in Germany on Nov. 10, 2011, and which are both herein incorporated by reference.

BACKGROUND OF THE INVENTION

1. Field of the Invention

The present invention relates to an exercise machine for exercising at least one limb, in particular for use in rehabilitation and/or fitness, having a support frame and a generator of circular motion that is rotatably mounted on a rotary shaft associated with the support frame, and having a limb rest for supporting and/or holding the at least one limb.

2. Description of the Background Art

Oftentimes, different movement patterns are needed for targeted exercise of individual muscle groups in the limbs. With a bicycle ergometer, for example, circular movements are executed to strengthen the leg muscles. With an elliptical machine, in contrast, a typical running movement is simulated, and the movement of the legs follows an elliptical path. With a rowing machine, in turn, the legs carry out a linear movement. Pieces of equipment that are intended for performing the individual motions are thus already well known from the prior art. The problem, however, is that a separate machine must be kept on hand for performing each individual form of movement, which, in addition to taking a great deal of space, also calls for a high investment of resources. Moreover, the problem often exists in the case of a strictly linear movement that the movement pattern is not fluid, and the reversal point always represents a dead point. Furthermore, a targeted variation in the orientation of the path of the movement cannot be accomplished with the exercise machines.

SUMMARY OF THE INVENTION

It is therefore an object of the present invention to provide an exercise machine that permits variable exercise.

This object is attained according to an embodiment of the invention in an exercise machine in that a rotating shaft for rotatable mounting of a rotator is associated with the generator of circular motion and is radially offset from the rotary shaft of the generator of circular motion, that the limb rest is associated with the rotator, preferably is eccentric to the rotating shaft, and that the trajectory of the limb rest is described by an ellipse that is produced by a superposition of the circular motion of the generator of circular motion and of the rotator.

A very compact construction of the exercise machine can be achieved by the arrangement described. Furthermore, the limb rest can be attached to the rotator in different ways, with the result that different movement patterns can be realized, in particular the position and size of the semiaxes of the ellipse can be varied, which causes different muscle groups to be exercised. Moreover, the exercise machine according to the invention replaces multiple conventional exercise machines, resulting in cost advantages in addition to reduced space requirements.

It is additionally advantageous for the invention when a coupling of the rotator to the support frame is provided to derive the rotation of the rotator from the circular motion of the circular motion generator. This ensures that a rotation of the rotator takes place about the rotating shaft when the circular motion generator rotates, by which means the superposition of the two circular motions to produce an elliptical motion takes place.

Moreover, it is advantageous for the invention when a takeoff wheel is associated with the support frame in a rotationally fixed manner and a drive wheel is associated with the rotator in a rotationally fixed manner, and when the takeoff wheel and the drive wheel are coupled to one another by a chain, a belt, or the like. This has the advantage that the coupling is very failure-resistant, which works to the benefit of the operational reliability of the exercise machine.

Furthermore, it is very beneficial for the user-friendliness of the exercise machine according to the invention when different radii are given to the takeoff wheel and the drive wheel in order to produce a gear ratio reduction or increase. This produces the result that the exercise machine can be adjusted specifically for the athlete or patient.

It has proven to be an advantage for the exercise machine according to the invention when a housing collar that is concentric to the rotary shaft is arranged on the support frame, and when a driving disk, which is preferably designed to be integral with the rotator, is associated with the rotating shaft in order to couple the rotator to the support frame through contact of the driving disk on the housing collar. This wear-resistant type of coupling between the rotator and the support frame results in a reduction in maintenance effort and thus benefits user-friendliness of the exercise machine according to the invention.

It has proven to be especially favorable when the distance between the rotating shaft and the limb rest is adjustable to set the size of the semiaxes of the ellipse, and the angle between the rotary shaft/rotating shaft and rotating shaft/limb rest is adjustable to align the semiaxes of the ellipse. In this way, the exercise machine can be set to meet the needs and desires of the exerciser or patient, which improves the versatility and user-friendliness of the exercise machine.

For use in fields including rehabilitation, specifically in patients who have a transverse lesion of the spinal cord, it has proven beneficial for a motor to be provided for driving the rotary shaft. This has the advantage that even patients with limited or nonexistent motor capabilities can exercise the muscles of their limbs in a targeted way.

It has proven especially beneficial for user-friendliness of the exercise machine when two of the units mounted on the rotary shaft are provided, and they are combined as a first pair to be used by a first pair of limbs. It is ensured by this means that a pair of limbs is exercised jointly, which increases the training effect and also has physiological benefits.

It is additionally advantageous in an embodiment when the phase shift between the two circular motion generators is adjustable. This permits a variety of exercise opportunities for the patient or exerciser.

For an additional application, it has furthermore proven to be useful when a second pair of units is present for use by a second pair of limbs. It is ensured by this means that exercise of the legs, for example, can take place at the same time as exercise of the arms.

It has additionally proven to be beneficial when the first pair and the second pair are coupled to one another. As a result, it is possible in the case of a patient with an injury of the spinal cord in the vicinity of the cervical vertebral column and a resultant immobility of all four limbs, for example, that the limbs can all be exercised with just one motor. On the other hand, the movement of one pair of limbs can be supported by the movement of the second pair of limbs.

It has also proven especially advantageous for the exercise machine when the angle and the distance between the first pair and the second pair can be changed. As a result, the exercise machine can be adapted to the particular physiology of the patient or exerciser.

Moreover, it has also proven especially beneficial when the rotator is implemented by a disk with which are associated multiple holes for receiving the limb rest that are arranged on concentric circles for the purpose of varying the semiaxes of the ellipse and/or their orientation. Due to the arrangement of the holes on concentric circles having different radii, it is possible to realize different forms of movement. If the limb rest is mounted as an extension of the rotating shaft, the elliptical motion becomes a circular motion. The further away from the rotating shaft the limb rest is mounted, the more the elliptical motion resembles a translation. However, since it is always still an ellipse, a round shape of the movement is retained, which serves user-friendliness.

It has also proven beneficial for user-friendliness when slots are formed in the disk to receive the limb rest. As a result of the use of slots, the form of the ellipse and its orientation can be varied very minutely.

It is especially favorable for the exercise machine according to the invention when the distance of the limb rest from the rotating shaft and the orientation of the rotator relative to the circular motion generator are freely selectable by means of snap-in and/or screw connectors associated with the rotator. This makes it possible to adjust the shape and orientation of the movements to the needs of the patient.

In addition, it has proven advantageous for the invention when the rotator is implemented as a plug-in connector that can be attached to the rotating shaft with different orientations by means of predetermined detent positions, and with which are associated at least three receptacle positions for receiving the limb rest that have different distances from the rotating shaft in order to vary the semiaxes of the ellipse. This has a positive effect on the user-friendliness of the exercise machine according to the invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
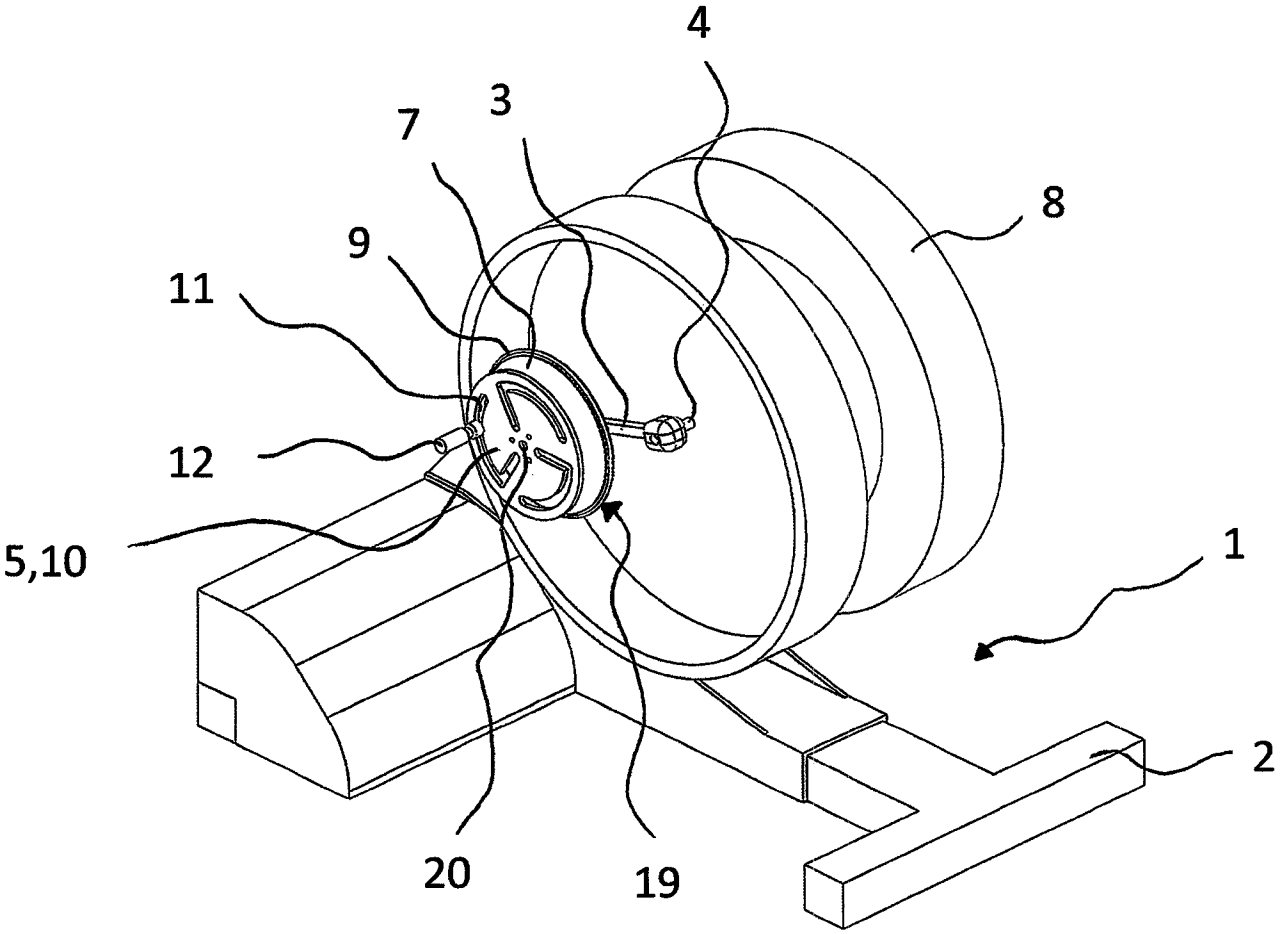
FIG. 1 is a perspective view of an exercise machine with a rotator implemented as a disk, and a coupling between the support frame and rotator through a combination of housing drum and driving disk.

FIG. 1 shows a first embodiment of an exercise machine 1 according to the invention. Evident in the embodiment shown are a support frame 2 of the exercise machine 1 and the attachment of a generator of circular motion 3 to a rotary shaft 4. Eccentric to the rotary shaft 4 on the circular motion generator 3, a rotator 5 is mounted on a rotating shaft 6. In this embodiment, the coupling between the support frame 2 and the rotator 5 is implemented by a driving disk 7, which rolls on a housing collar 8 during a rotation of the circular motion generator 3. For this purpose, the housing collar 8 is attached to the support frame 2 so as to be rotationally fixed and coaxial to the rotary shaft 4. For better coupling, in the exemplary embodiment shown a rubber ring 9, which is intended for contact on the housing collar 8, is mounted on the outer circumference of the driving disk 7. However, it is of course also possible for the coupling to take place without this rubber ring 9. Moreover, it is also possible within the scope of the exercise machine 1 according to the invention for the driving disk 7 to be made integral with the rotator 5. In the exemplary embodiment shown, the rotator 5 is implemented as a disk 10, which has slots 11 for accommodating a limb rest 12. A diversity of movement patterns can be realized by means of the slots 11, which can vary in number and precise implementation from the exemplary embodiment shown. It should additionally be noted that the limb rest 12 can also be mounted in axial extension to the rotating shaft 6. In this case, which is not shown, the limb rest 12 would describe a strictly circular motion.

Figure 2:
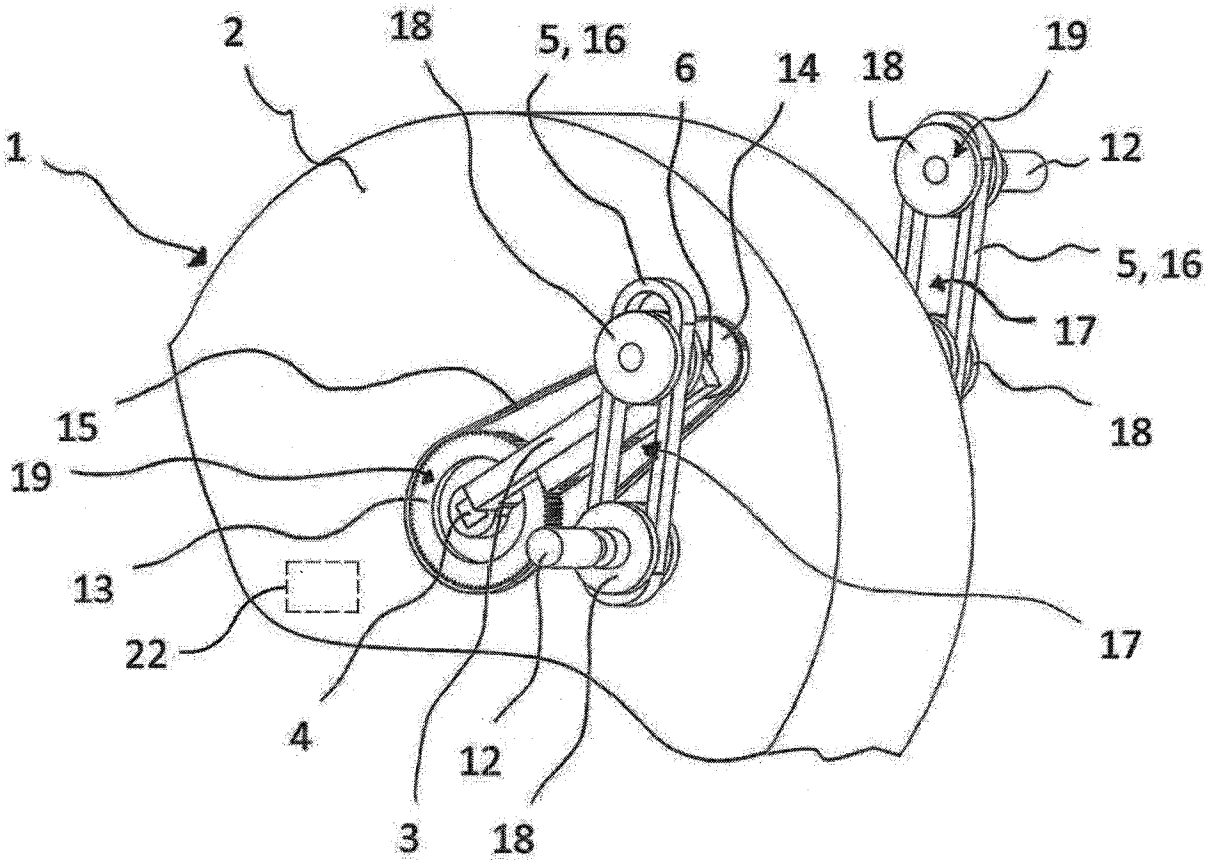
FIG. 2 a perspective detail view of the coupling between a rotator implemented as a frame and a support frame through a combination of drive wheels and a corresponding belt.

FIG. 2 shows a detail view of another exercise machine 1 according to the invention with an alternative coupling between the rotator 5 and the support frame 2. It is visible here that the coupling between the rotator 5 and the support frame 2 is realized through the use of a takeoff wheel 13, which is connected to the support frame 2 in a rotationally fixed manner, and a drive wheel 14, which is connected to the rotator 5 in a rotationally fixed manner by means of the rotating shaft 6. For the purpose of coupling in this design, the takeoff wheel 13 and drive wheel 14 are connected to one another by a belt 15. Depending on the embodiment of the takeoff wheel 13 and drive wheel 14, the belt 15 in this design can be implemented differently. Thus, the use of a combination of sprockets and a chain is also possible, for example. The circular motion generator 3 is implemented in two parts in the embodiment shown. This has the advantage that the two parts of the circular motion generator 3 can be pushed against one another in order to tension the belt 15 that connects the takeoff wheel 13 and the drive wheel 14 to one another. In the embodiment shown, the rotator 5 is implemented as a frame 16, and has an oblong frame hole 17 at which the rotating shaft 6 and the limb rest 12 can be attached through the use of suitable—in and/or screw connectors 18. This attachment is accomplished such that the polar coordinates, and hence the trajectory, of the limb rest 12 are freely adjustable. In the exemplary embodiment shown, two units 19 attached to the rotary shaft 4, each of which is composed of a circular motion generator 3 with a rotator 5 coupled to the support frame 2 and a limb rest 12, are associated with the exercise machine 1. The phase shift between the two circular motion generators 3 that are shown is 0°, but can be adjusted. Since the angles between the rotary shaft 4/rotating shaft 6 and rotating shaft 6/limb rest 12 are different for the two units 19 in the exemplary embodiment shown, the orientation of the resulting ellipses of the limb rests 12 is also different. It is additionally possible within the scope of the exercise machine 1 according to the invention for a motor 22 to be provided for driving the rotary shaft 4. This preferably is located in the support frame 2 as shown via dashed lines.

Figure 3:
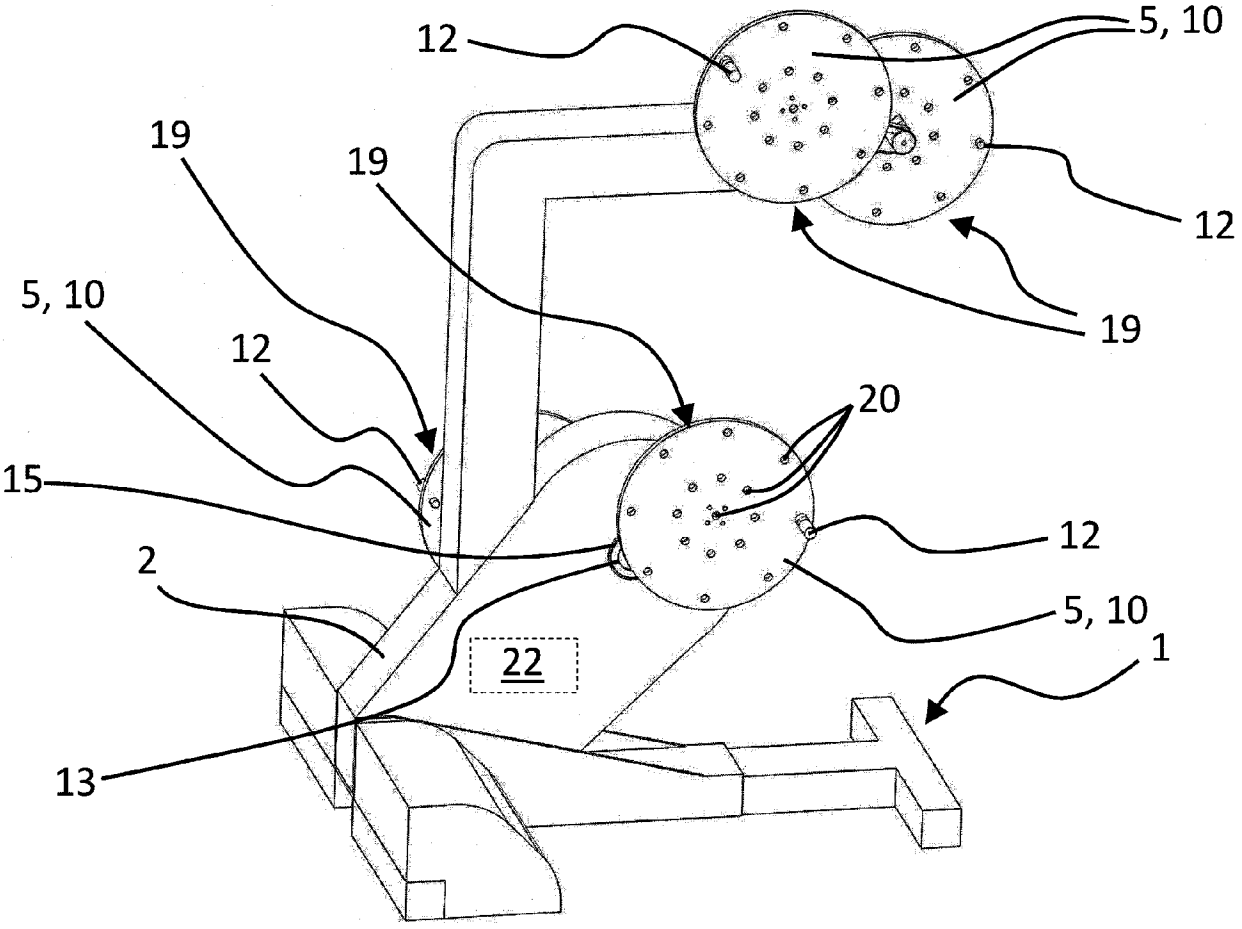
FIG. 3 a perspective view of the exercise machine with a rotator implemented as a disk.

FIG. 3 shows another embodiment of a rotator 5 of the exercise machine 1 according to the invention. In this design, the rotator 5 is implemented as a disk 10 that is attached to the rotating shaft 6. The disk 10 has holes 20 for receiving the limb rest 12. It should be noted that the holes 20 are located at different radial distances from the rotating shaft 6. The shape of the trajectory of the limb rest 12 can be established by this means. If the limb rest 12 is coaxial to the rotating shaft 6, then the limb rest 12 executes a strictly circular motion, in a similar fashion to a bicycle ergometer. If the limb rest 12 is displaced outward radially from the rotating shaft 6, the trajectory of the limb rest 12 assumes an elliptical shape, which transitions into a linear shape with increasing distance of the limb rest 12 from the rotating shaft 6, although it always retains its elliptical character. This has the advantage that a round motion is always ensured. In the exemplary embodiment shown, the holes 20 for receiving the limb rest 12 are arranged on concentric circles. As a result, the orientation of the trajectory of the limb rest 12 can be varied without changing the elliptical shape. Within the scope of the exercise machine 1 according to the invention, it is also possible to use slots 11 in place of holes 20. In the exemplary embodiment shown, the phase shift between the two circular motion generators 3 is 180°, but can also be varied, however. FIG. 3 also shows that two pairs of circular motion generators can be provided for two pairs of limbs.

Figure 4:
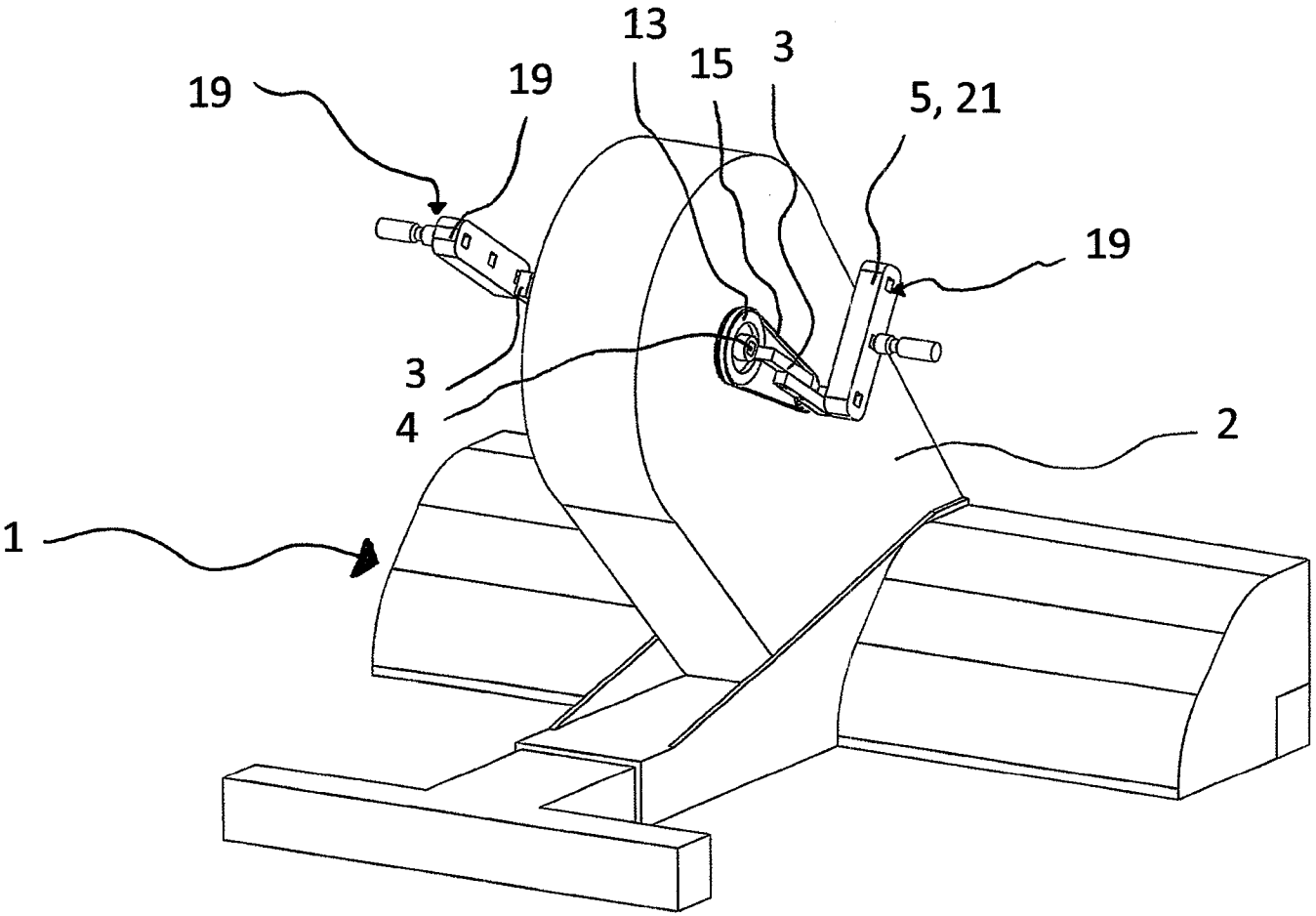
FIG. 4 a perspective view of the exercise machine with a rotator implemented as a plug-in connector.

FIG. 4 shows another embodiment of the rotator 5 of an exercise machine 1 according to the invention. It can be seen that the rotator 5 is implemented as a plug-in connector 21, which can be fitted onto the rotating shaft 6 at different orientations. In this way, it is possible to realize different orientations of the ellipses of the limb rests 12. The length of the semiaxes of the ellipses can be changed by the means that the limb rest 12 may be attached at predetermined positions on the plug-in connector 21 whose distance from the rotating shaft 6 determines the resulting trajectory of the limb rest 12. As in the exemplary embodiments discussed above, the resultant trajectory of the limb rest 12 is determined by the distance of the rest from the rotating shaft 6. It should be noted that here, too, the movement is always an ellipse, regardless of the distance between the rotating shaft 6 and limb rest 12, which always permits a round motion and avoids a dead point at the reversal points. In the exemplary embodiment shown, the two circular motion generators 3 are phase-shifted from one another by 180°. It can also be seen that the two limb rests 12 shown have different orientations and are different distances from the applicable rotating shaft 6. Even though this is not particularly useful in everyday use, it does highlight the versatile adjustment capabilities of the exercise machine 1 according to the invention.

It should thus be noted that the exercise machine 1 according to the invention offers a variety of adjustment possibilities. In the following, the mode of operation shall be explained once more using the embodiment shown in FIG. 2. Two units 19 are arranged as a pair here. The phase shift between the two circular motion generators 3, which is 0° in the exemplary embodiment shown, can be adjusted by different attachment of the circular motion generator 3 to the rotary shaft 4. The trajectory of the individual limb rests 12 can also be changed individually. For this reason, the limb rest 12 is attached to a snap-in and/or screw connector 18, which is mounted to be freely movable in an oblong frame hole 17 of a frame 16. The closer the limb rest 12 is attached to the rotating shaft 6, the more closely its trajectory resembles a circular motion. For a strictly circular motion, the limb rest 12 can be attached to the rotator 5 in extension of the rotating shaft 6. In the exemplary embodiment shown, the trajectories of the two limb rests 12 have approximately the same shape. Since the distance of the limb rest 12 from the applicable rotating shaft 6 is quite long, the movements are characterized by a nearly linear, but still elliptical, shape. Moreover, the two elliptical paths are offset from one another by approximately 90°. This orientation is determined by the angle between rotary shaft 4/rotating shaft 6 and rotating shaft 6/limb rest 12, which can be varied freely in the exemplary embodiment shown.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An exercise machine for exercising at least one limb, in particular for use in rehabilitation and/or fitness, the exercise machine comprising:

a support frame;

a circular motion generator that is rotatably mounted on a rotary shaft associated with the support frame;

a limb rest for supporting or holding the at least one limb; and a rotating shaft for rotatable mounting of a rotator and being associated with the circular motion generator, the rotating shaft being radially offset from the rotary shaft of the circular motion generator such that the limb rest is associated with the rotator and is eccentric to the rotating shaft, wherein a trajectory of the limb rest is described by an ellipse that is produced by a superposition of the circular movements of the circular motion generator and of the rotator, wherein the rotator is coupled to the support frame, such that rotation of the rotator is derived from the circular motion of the circular motion generator, and wherein a housing collar that is concentric to the rotary shaft is arranged on the support frame, wherein a driving disk that is adapted to be integral with the rotator is associated with the rotating shaft to couple the rotator to the support frame through contact of the driving disk on the housing collar.

2. The exercise machine according to claim 1, wherein the distance between the rotating shaft and the limb rest is adjustable to set the size of the semiaxes of the ellipse, and wherein an angle between the rotary shaft and the rotating shaft and an angle between the rotating shaft and the limb rest is adjustable to align the semiaxes of the ellipse.

3. The exercise machine according to claim 1, wherein the rotator is implemented by a disk and wherein slots are formed in the disk to receive the limb rest.

4. An exercise machine for exercising at least one limb, in particular for use in rehabilitation and/or fitness, the exercise machine comprising:

a support frame;

a circular motion generator that is rotatably mounted on a rotary shaft associated with the support frame;

a limb rest for supporting or holding the at least one limb; and a rotating shaft for rotatable mounting of a rotator and being associated with the circular motion generator, the rotating shaft being radially offset from the rotary shaft of the circular motion generator such that the limb rest is associated with the rotator and is eccentric to the rotating shaft, wherein a trajectory of the limb rest is described by an ellipse that is produced by a superposition of the circular movements of the circular motion generator and of the rotator, wherein a motor is provided for driving the rotary shaft.

5. The exercise machine according to claim 4, wherein the rotator is coupled to the support frame, such that rotation of the rotator is derived from the circular motion of the circular motion generator, and wherein a takeoff wheel is associated with the support frame in a rotationally fixed manner and a drive wheel is associated with the rotator in a rotationally fixed manner, and wherein the takeoff wheel and the drive wheel are coupled to one another by a chain or a belt.

6. The exercise machine according to claim 5, wherein the takeoff wheel and the drive wheel each have different radii in order to produce a gear ratio reduction or increase.

7. The exercise machine according to claim 4, wherein two of the circular motion generators mounted on the rotary shaft are provided, and wherein the circular motion generators are combined as a first pair to be used by a first pair of limbs.

8. The exercise machine according to claim 7, wherein a phase shift between the two circular motion generators is adjustable.

9. An exercise machine for exercising at least one limb, in particular for use in rehabilitation and/or fitness, the exercise machine comprising:

a support frame;

a circular motion generator that is rotatably mounted on a rotary shaft associated with the support frame;

a limb rest for supporting or holding the at least one limb; and a rotating shaft for rotatable mounting of a rotator and being associated with the circular motion generator, the rotating shaft being radially offset from the rotary shaft of the circular motion generator such that the limb rest is associated with the rotator and is eccentric to the rotating shaft, wherein a trajectory of the limb rest is described by an ellipse that is produced by a superposition of the circular movements of the circular motion generator and of the rotator, and wherein the rotator is implemented by a disk with which are associated multiple holes for receiving the limb rest that are arranged on concentric circles for the purpose of varying semiaxes of the ellipse and/or their orientation.

10. An exercise machine for exercising at least one limb, in particular for use in rehabilitation and/or fitness, the exercise machine comprising:

a support frame;

a circular motion generator that is rotatably mounted on a rotary shaft associated with the support frame;

a limb rest for supporting or holding the at least one limb; and a rotating shaft for rotatable mounting of a rotator and being associated with the circular motion generator, the rotating shaft being radially offset from the rotary shaft of the circular motion generator such that the limb rest is associated with the rotator and is eccentric to the rotating shaft, wherein a trajectory of the limb rest is described by an ellipse that is produced by a superposition of the circular movements of the circular motion generator and of the rotator, and wherein a distance of the limb rest from the rotating shaft and an orientation of the rotator relative to the circular motion generator are freely selectable via snap-in and/or screw connectors associated with the rotator.

11. An exercise machine for exercising at least one limb, in particular for use in rehabilitation and/or fitness, the exercise machine comprising:

a support frame;

a circular motion generator that is rotatably mounted on a rotary shaft associated with the support frame;

a limb rest for supporting or holding the at least one limb; and a rotating shaft for rotatable mounting of a rotator and being associated with the circular motion generator, the rotating shaft being radially offset from the rotary shaft of the circular motion generator such that the limb rest is associated with the rotator and is eccentric to the rotating shaft, wherein a trajectory of the limb rest is described by an ellipse that is produced by a superposition of the circular movements of the circular motion generator and of the rotator, and wherein the rotator is implemented as a plug-in connector that is attachable to the rotating shaft with different orientations via predetermined detent positions, and with which are associated at least three receptacle positions for receiving the limb rest that have different distances from the rotating shaft in order to vary the semiaxes of the ellipse.

* * * * *